US010934682B2

(12) United States Patent
Feld et al.

(10) Patent No.: US 10,934,682 B2
(45) Date of Patent: Mar. 2, 2021

(54) STRAIGHT TAPER DIPPER

(71) Applicant: Joy Global Surface Mining Inc, Milwaukee, WI (US)

(72) Inventors: Dan Feld, South Milwaukee, WI (US); Richard Nicoson, Hartford, WI (US); William R. Powers, Mukwonago, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 16/729,595

(22) Filed: Dec. 30, 2019

(65) Prior Publication Data

US 2020/0157766 A1 May 21, 2020

Related U.S. Application Data

(63) Continuation of application No. 14/686,435, filed on Apr. 14, 2015, now Pat. No. 10,519,621, which is a continuation of application No. 13/452,380, filed on Apr. 20, 2012, now abandoned.

(60) Provisional application No. 61/481,615, filed on May 2, 2011.

(51) Int. Cl.

| | |
|---|---|
| ***E02F 3/40*** | (2006.01) |
| ***E02F 3/60*** | (2006.01) |
| ***E02F 3/407*** | (2006.01) |

(52) U.S. Cl.

CPC ..... *E02F 3/40* (2013.01); *E02F 3/4075* (2013.01); *E02F 3/60* (2013.01)

(58) Field of Classification Search

CPC ..... E02F 3/40; E02F 3/4075; E02F 3/60

See application file for complete search history.

(56) References Cited

U.S. PATENT DOCUMENTS

| | | | |
|---|---|---|---|
| 708,587 | A | 9/1902 | Robinson |
| 838,914 | A | 12/1906 | Strom |
| 1,031,138 | A | 7/1912 | McKee et al. |
| 1,333,852 | A | 3/1920 | Kittredge |

(Continued)

FOREIGN PATENT DOCUMENTS

| | | | |
|---|---|---|---|
| AU | 2005201272 | A1 | 11/2005 |
| AU | 2012202101 | A1 | 11/2012 |

(Continued)

OTHER PUBLICATIONS

Decision of Rejection issued by the Chinese Patent Office for related Application No. 201511024836.6 dated Nov. 14, 2018 (18 pages including English translation).

(Continued)

*Primary Examiner* — Jessica H Lutz

(74) *Attorney, Agent, or Firm* — Michael Best & Friedrich LLP

(57) ABSTRACT

A dipper having an inlet and an outlet. The dipper includes a front wall and an opposite back wall extending between the inlet and the outlet. The front wall has a substantially linear inner surface between the inlet and the outlet. The dipper further includes two side walls connected between the front wall and the back wall and extending between the inlet and the outlet. Further, the dipper has a lip coupled to the front wall and extending outwardly from the inlet in a direction away from the outlet, the lip having a lip inner surface arranged generally parallel with the substantially linear inner surface of the front wall.

14 Claims, 7 Drawing Sheets

(56) References Cited

U.S. PATENT DOCUMENTS

| | | | |
|---|---|---|---|
| 1,477,539 | A | 12/1923 | Clark |
| 1,479,340 | A | 1/1924 | Trainor |
| 1,481,273 | A | 1/1924 | Roe |
| 1,496,407 | A | 6/1924 | Black |
| 1,508,322 | A | 9/1924 | Heller |
| 1,545,943 | A | 1/1925 | Crane |
| 1,539,863 | A | 6/1925 | Pemberton |
| 1,573,128 | A | 2/1926 | Baker |
| 1,582,577 | A | 4/1926 | Crane |
| 1,638,099 | A | 8/1927 | Rorabeck |
| 1,745,436 | A | 2/1930 | Miley |
| 1,757,328 | A | 5/1930 | Mullally |
| 1,770,543 | A | 7/1930 | Miley |
| 1,796,737 | A | 3/1931 | Buskirk |
| 1,914,104 | A | 6/1933 | Black |
| 2,025,090 | A | 12/1935 | Brurke |
| 2,003,067 | A | 5/1936 | Brune |
| 2,185,176 | A | 1/1940 | Bager |
| 2,243,965 | A | 6/1941 | Larsen |
| 2,336,729 | A | 12/1943 | Harris et al. |
| 2,427,897 | A | 10/1947 | Burdick et al. |
| 2,623,309 | A | 12/1952 | Frye |
| 2,660,323 | A | 11/1953 | Carlesimo |
| 2,704,613 | A | 3/1955 | Biedess |
| 2,724,518 | A | 11/1955 | Charlton et al. |
| 2,874,491 | A | 2/1959 | Larsen |
| 2,926,800 | A | 3/1960 | Larsen et al. |
| 3,003,264 | A | 10/1961 | Shore |
| 3,107,445 | A | 10/1963 | Ratkowski |
| 3,402,486 | A | 9/1968 | Branson |
| 3,508,674 | A | 4/1970 | Schneider et al. |
| 3,914,885 | A | 10/1975 | Moreau |
| 4,449,309 | A | 5/1984 | Hemphill |
| 4,517,756 | A | 5/1985 | Olds et al. |
| 4,939,855 | A | 7/1990 | McCreary, Jr. |
| 5,063,694 | A | 11/1991 | McCreary, Jr. |
| 5,353,531 | A | 10/1994 | Doucette |
| 5,400,530 | A | 3/1995 | Schmidt |
| 5,815,959 | A | 10/1998 | Bahner |
| 5,815,960 | A | 10/1998 | Soczka |
| 5,901,480 | A | 5/1999 | Shamblin |
| 5,909,961 | A | 6/1999 | Pullman |
| 6,434,862 | B1 | 8/2002 | Hren |
| 7,096,610 | B1 | 8/2006 | Gilmore |
| 7,191,553 | B2 | 3/2007 | Doucette et al. |
| 7,832,128 | B2 | 11/2010 | Doucette et al. |
| 8,590,180 | B2 | 11/2013 | Hren et al. |
| 2007/0107269 | A1 | 5/2007 | Hren et al. |
| 2010/0005689 | A1 | 1/2010 | Leslie |

FOREIGN PATENT DOCUMENTS

| | | | |
|---|---|---|---|
| CA | 2548874 | A1 | 12/2006 |
| CN | 1740461 | A | 3/2006 |
| EP | 1967655 | A2 | 9/2008 |
| GB | 429296 | | 5/1935 |
| GB | 2399562 | A | 9/2004 |
| SU | 505772 | A1 | 4/1976 |
| SU | 715707 | A1 | 2/1980 |

OTHER PUBLICATIONS

Office Action issued from the Canadian Patent Office for related Application No. 2775868 dated Jan. 30, 2019 (3 pages).

"New tricks for old dogs," Machines Past & Present, Earthmovers, Jun. 2006, pp. 111-112.

Shi, N. et al., "A new Canadian shovel dipper design for improved performance," CIM Bulletin, vol. 99, No. 1093, Mar./Apr. 2006.

Joseph, T.G. et al. "Qualitative observations of dipper performance and design concerns for oil sands use," CIM Conference, May 11, 2010.

Joseph, T.G. et al. "Scaling to Full Size Dipper Design Via Geometric and Performance Field Data," World Congress on Engineering 2010, vol. II, Jun. 30-Jul. 2, 2010.

First Office Action from the State Intellectual Property Office of China for Application No. 201210125448.5 dated Aug. 5, 2015 (19 pages).

First Office Action from the State Intellectual Property Office of China for Application No. 201511024836.6 dated Jul. 4, 2017 (22 pages).

Australian Patent Office Examination Report for Application No. 2012202435 dated May 16, 2014 (5 pages).

Australian Patent Office Examination Report No. 2 for Application No. 2012202435 dated Nov. 18, 2014 (3 pages).

First Office Action from the Australian Intellectual Property Office for Application No. 2015202548 dated Jan. 9, 2016 (4 pages).

First Office Action from the Chilean Patent Office for Application No. 1116-2012 dated Oct. 14, 2015 (11 pages).

STRAIGHT TAPER DIPPER

CROSS-REFERENCE TO RELATED APPLICATIONS

The present patent application is a continuation of U.S. patent application Ser. No. 14/686,435, titled "STRAIGHT TAPER DIPPER" and filed Apr. 14, 2015 by Dan Feld et al., which is a continuation of U.S. patent application Ser. No. 13/452,380, titled "STRAIGHT TAPER DIPPER" and filed Apr. 20, 2012 by Dan Feld et al., which claims priority to U.S. Provisional Patent Application No. 61/481,615, titled "STRAIGHT TAPER DIPPER" filed May 2, 2011 by Dan Feld et al., the entire contents of all of which are incorporated by reference herein.

FIELD

The present invention generally relates to dippers for surface mining.

SUMMARY

Typical power shovels or excavators use a bucket or dipper assembly to scoop earthen material from horizontal or vertical faces. A conventional power shovel has a boom, and the dipper is mounted on the boom via a crowd mechanism. The crowd mechanism includes a crowd pinion on the boom, and crowd rack as part of the dipper handle which pivots about the pinion and which moves translationally along the pinion. The dipper is mounted on the end of the handle. The bucket or dipper is normally provided with sharp teeth to provide a digging action against the surface being worked and further includes a cavity for collecting the material so removed. Once the earthen material is received within the dipper, the dipper is typically moved to another location for transfer of the material. The material is usually discharged into a dump truck, onto a conveyor, or merely onto a pile.

In one independent embodiment, a dipper has an inlet and an outlet and includes a front wall and an opposite back wall extending between the inlet and the outlet. A first reference plane extends from the inlet to the outlet and is positioned between the front wall and the back wall. The front wall may have a substantially linear inner surface and may be arranged relative to the first reference plane at an angle of at least 0 degrees and no more than 3 degrees. The dipper further includes two side walls connected between the front wall and the back wall and extending between the inlet and the outlet. A second reference plane extends from the inlet to the outlet and is positioned between the side walls. A lip is coupled to at least the front wall and extends outwardly from the inlet. The back wall may taper outwardly relative to the first reference plane from the inlet toward the outlet at an angle greater than 0 degrees and no more than 30 degrees, and each of the side walls may taper outwardly relative to the second reference plane from the inlet toward the outlet at an angle greater than 0 degrees and no more than 30 degrees.

In another independent embodiment of a dipper, each of the side walls of the dipper may taper outwardly relative to the second reference plane from the inlet toward the outlet at an angle greater than 0 degrees and no more than 30 degrees. The lip has opposite side surfaces, and each of the side surfaces of the lip may taper outwardly relative to the second reference plane from the inlet toward the outer surface at an angle greater than 0 degrees and no more than 30 degrees.

In yet another independent embodiment of the dipper, an inlet reference plane is defined at the inlet, and a front wall reference plane extends from the inlet to the outlet and is positioned between the front wall and the back wall. The front wall may have a substantially linear inner surface and be arranged relative to the front wall reference plane at an angle of at least 0 degrees and no more than 3 degrees. The inlet has an inlet area in the inlet reference plane, and the outlet has an outlet area in an outlet reference plane substantially parallel to the inlet reference plane. The front wall, the back wall, and the two side walls may be arranged such that the outlet area is at least 3 percent and no more than 25 percent greater than the inlet area.

Other independent aspects of the invention will become apparent by consideration of the detailed description and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Figure 1:
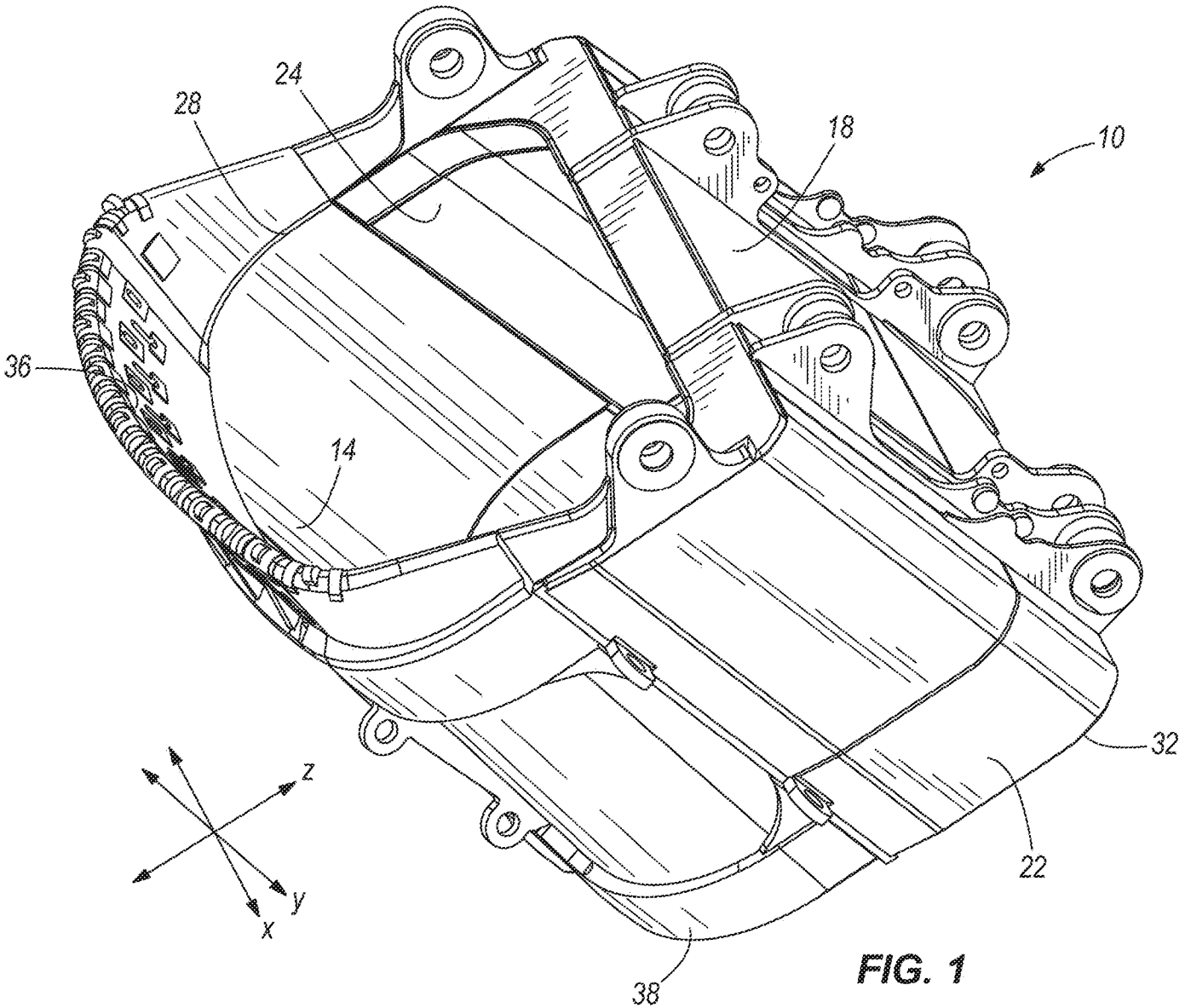
FIG. 1 is a perspective view of a dipper according to the invention.
Figure 2:
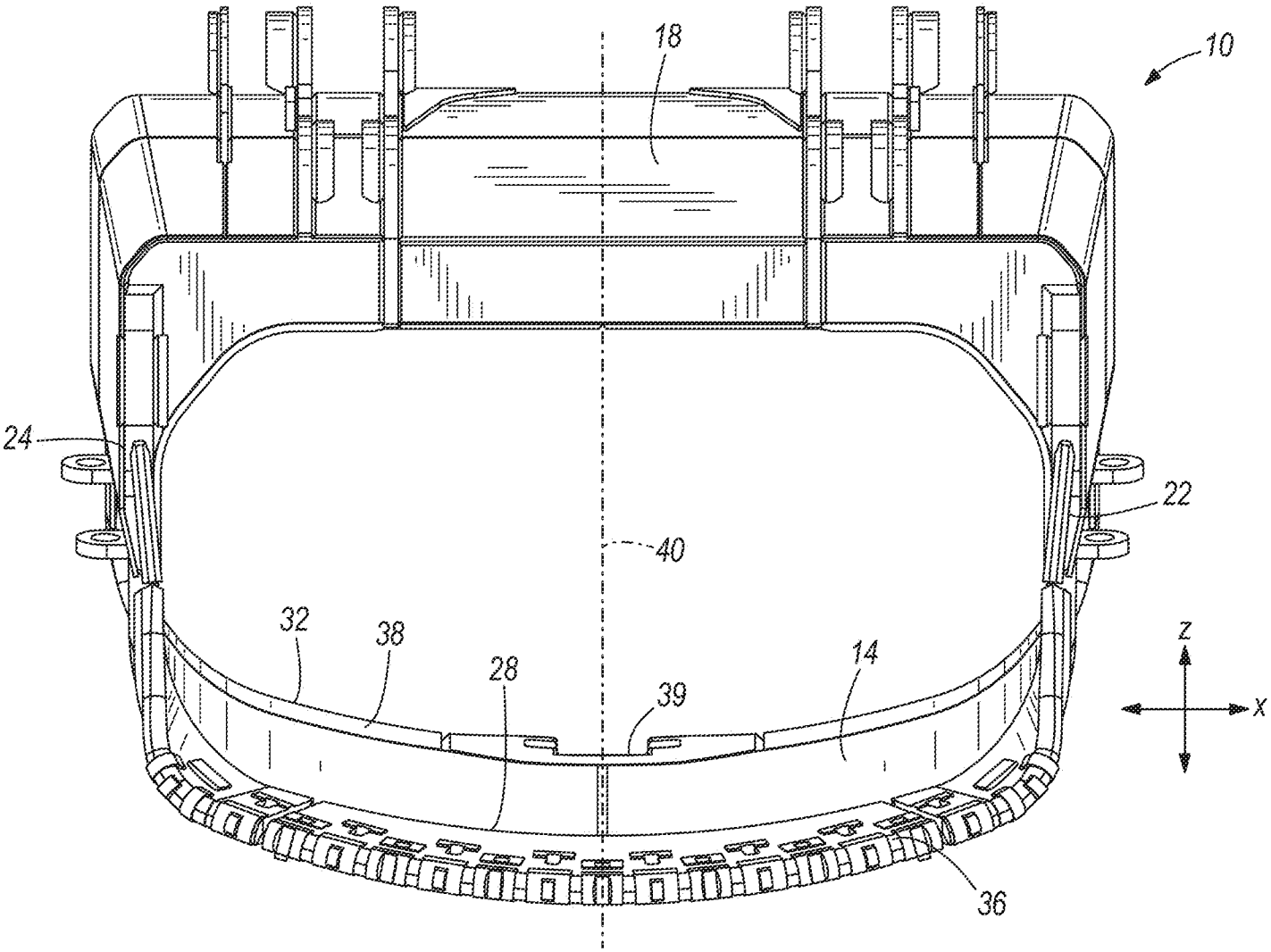
FIG. 2 is a top view of the dipper shown in FIG. 1.
Figure 3:
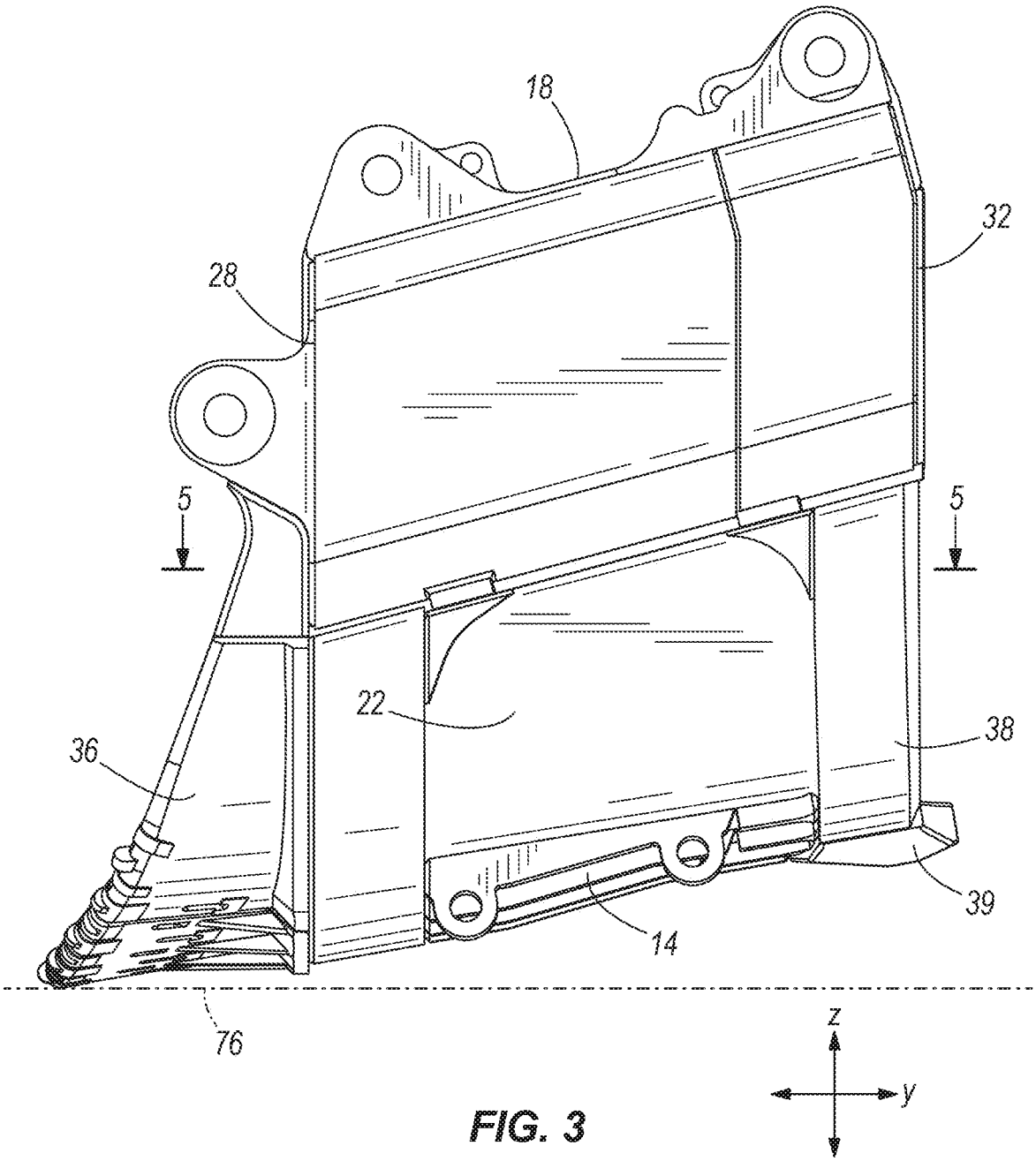
FIG. 3 is a right side view of the dipper shown in FIG. 1.
Figure 4:
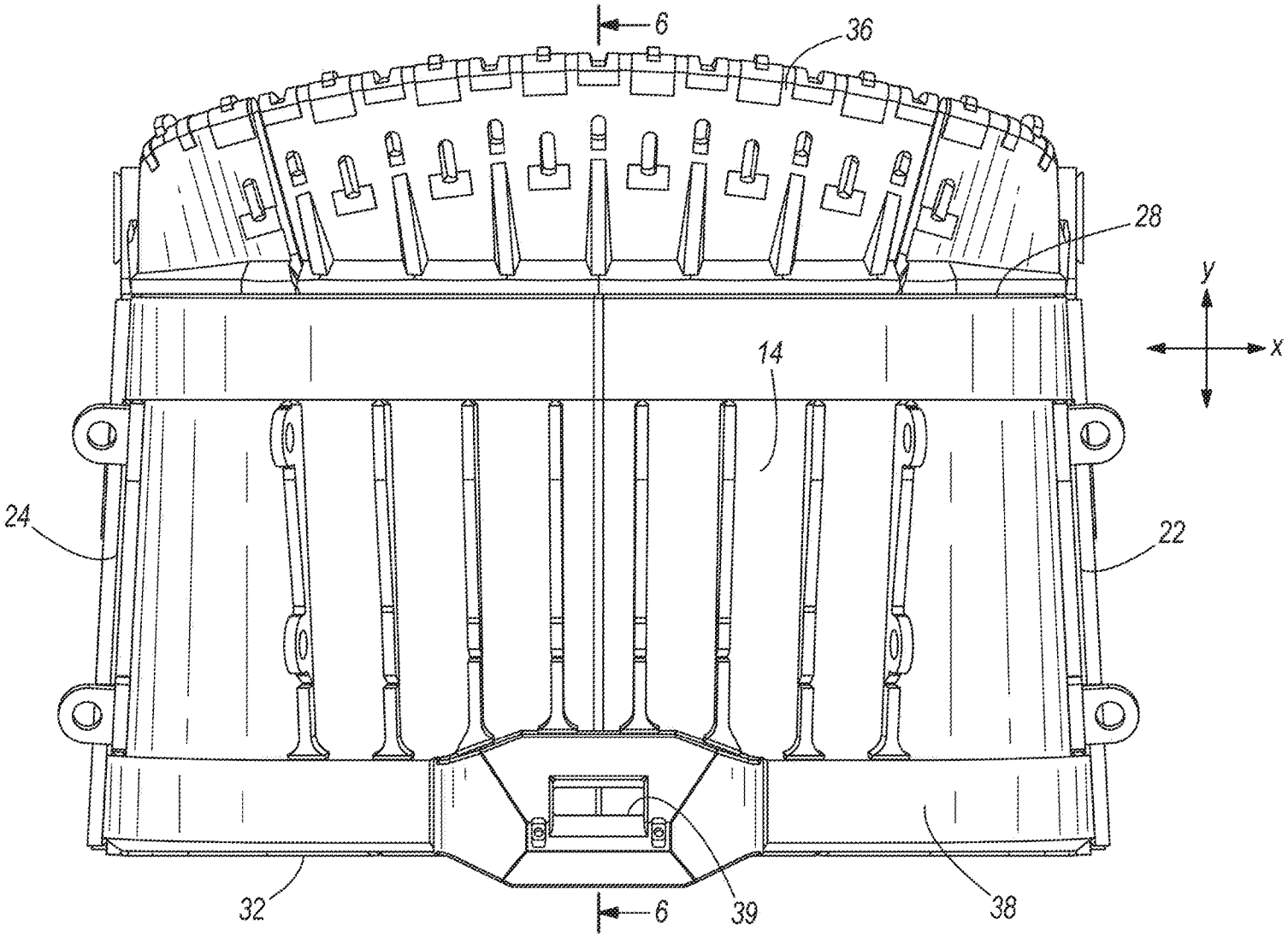
FIG. 4 is a front view of the dipper shown in FIG. 1.

FIG. 1 shows a dipper 10 for use with a power shovel or another piece of mining equipment. The dipper 10 includes a front wall 14, a back wall 18, a left side wall 22, and a right side wall 24 and defines an inlet 28 and an outlet 32. A lip 36 is coupled to the front wall 14, the left side wall 22, and the right side wall 24 and extends forward of the front wall 14. A heel 38 of the dipper is defined on the front wall 14 adjacent the outlet 32 and includes a latch portion 39 (see FIGS. 2-6) for receiving the latch of a dipper door (not shown). FIGS. 2-4 show alternate views of the dipper 10.

FIGS. 1-6 show an x-axis in a side-to-side direction, a y-axis in an inlet-to-outlet direction, and a z-axis in a front-to-back direction. These directions will be referenced throughout this description for the purpose of illustration and should not be regarded as limiting.

Figure 5:
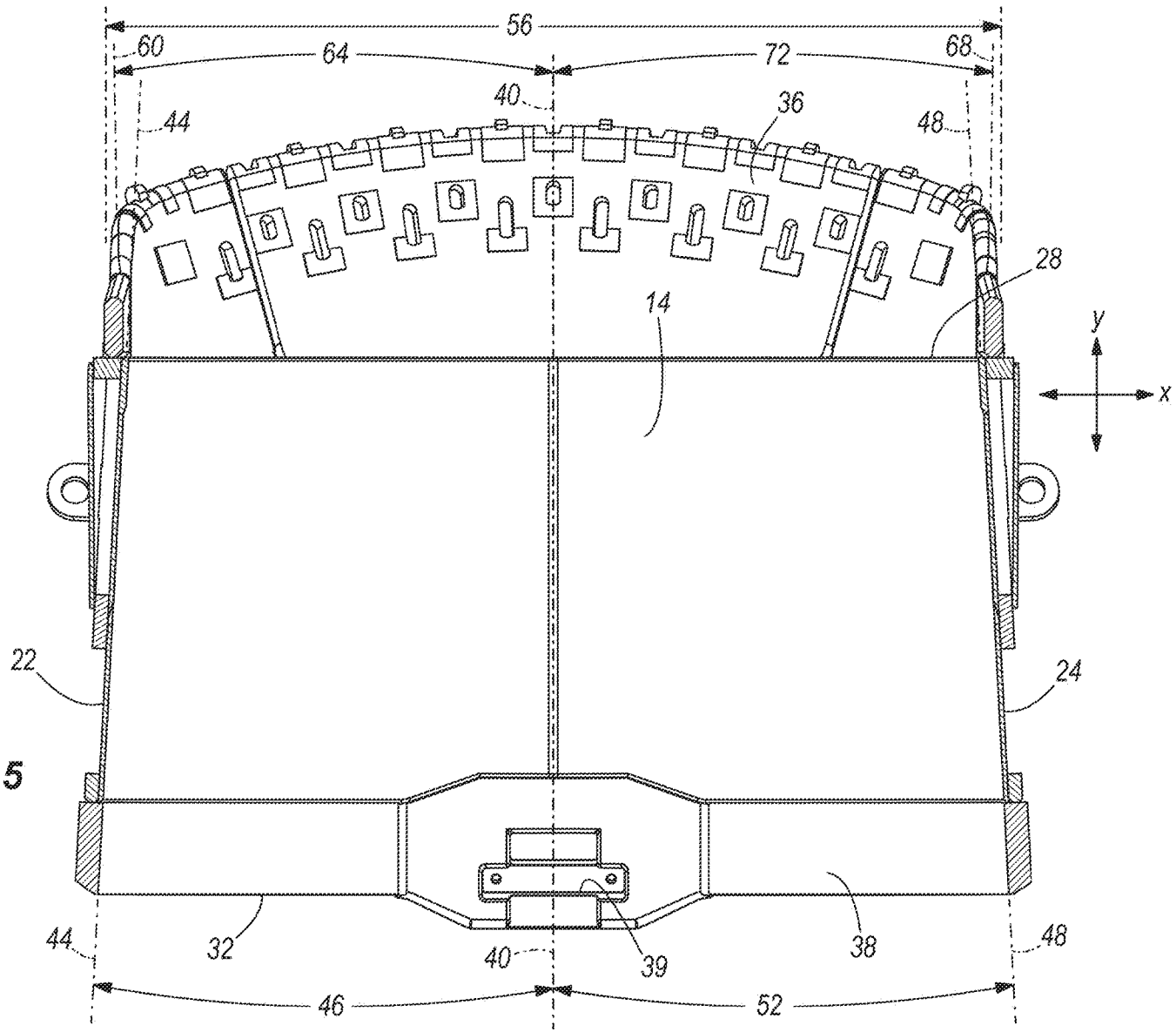
FIG. 5 is a section view taken along line 5-5 in FIG. 3.

With reference to FIG. 5, a side wall reference plane 40 is defined in the y-z plane and intersects the front wall 14 and the back wall 18 (e.g., in the center). The left side wall 22 defines (see FIG. 2) a planar portion and two curved portions that connect the planar portion of the left side wall 22 to the front wall 14 and the back wall 18. As shown in FIG. 5, the left side wall 22 is tapered or skewed outwardly from the inlet 28 to the outlet 32 and defines a left wall plane 44 that parallels the planar portion and that is angled with respect to the side wall reference plane 40 at a left wall angle 46. The left wall plane 44 may be angled with respect to the side wall reference plane 40 at between about zero degrees and about thirty degrees (0°≤x≤30°). In some embodiments, the left wall plane 44 may be angled with respect to the side wall reference plane 40 at between about one degree and about ten degrees (1°≤x≤10°). In the illustrated embodiment, the left wall angle 46 is about three degrees (3°).

The right side wall 24 defines (see FIG. 2) a planar portion and two curved portions that connect the planar portion of the right side wall 24 to the front wall 14 and the back wall 18. As shown in FIG. 5, the right side wall 24 is tapered or skewed outwardly from the inlet 28 to the outlet 32 and defines a right wall plane 48 that parallels the planar portion and that is angled with respect to the side wall reference plane 40 at a right wall angle 52. The right wall plane 48 may be angled with respect to the side wall reference plane 40 at between about zero degrees and about thirty degrees (0°≤x≤30°). In some embodiments, the right wall plane 48 may be angled with respect to the side wall reference plane 40 at between about one degree and about ten degrees (1°≤x≤10°). In the illustrated embodiment, the right wall angle 52 is about three degrees (3°).

FIG. 5 shows the lip 36 coupled to the front wall 14, the left side wall 22, and the right side wall 24. The lip 36 defines an outer dimension 56 along the x-axis, a left lip plane 60 running parallel to the left side of the lip 36, and a right lip plane 68 running parallel to the right side of the lip 36.

The left lip plane 60 is arranged at a left lip angle 64 with respect to the side wall reference plane 40. The left lip angle 64 may be between about zero degrees and about thirty degrees (0°≤x≤30°). In some embodiments, the left lip angle 64 is between about one degree and about ten degrees (1°≤x≤10°). In the illustrated embodiment, the left lip angle 64 is about zero degrees (0°).

The right lip plane 68 is arranged at a right lip angle 72 with respect to the side wall reference plane 40. The right lip angle 72 may be between about zero degrees and about thirty degrees (0°≤x≤30°). In some embodiments, the right lip angle 72 is between about one degree and about ten degrees (1°≤x≤10°). In the illustrated embodiment, the right lip angle 72 is about zero degrees (0°).

Further, in some embodiments, the lip 36 may be arranged with the outer dimension 56 of the lip 36 larger than a comparative outer dimension at the outlet 32 of the dipper 10 so that the outlet 32 or heel 38 of the dipper 10 does not plow or rake though the material being mined, which would increase the wear on the dipper 10 and increase the force required to move the dipper 10 through the material. The left and right lip angles 64, 72 affect the outer dimension 56 and can be manipulated to provide clearance for the outlet 32, as desired.

Figure 6:
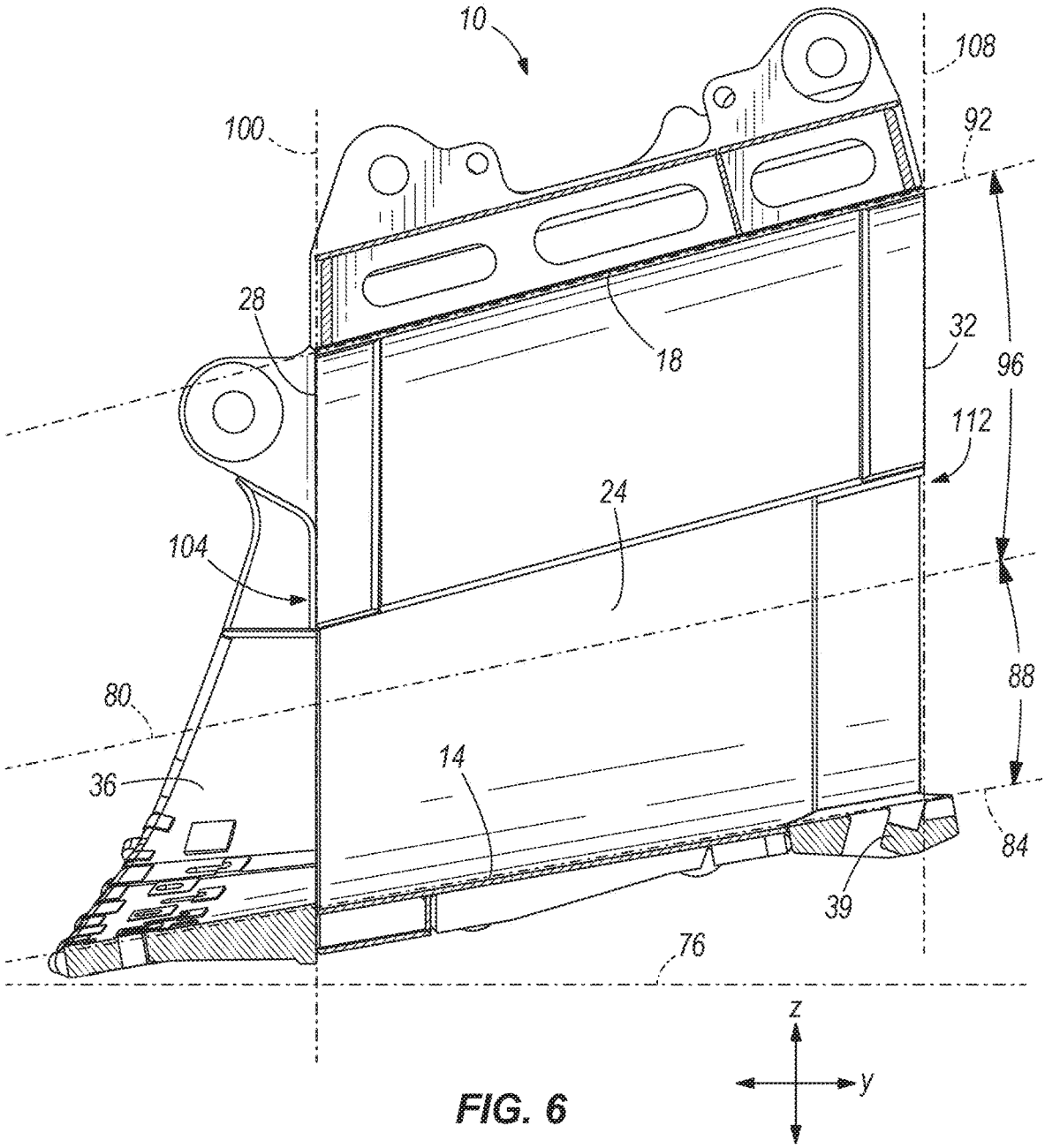
FIG. 6 is a section view taken along line 6-6 in FIG. 4.

With respect to FIG. 6, a floor reference plane 76 is defined in the x-y plane. A front/back wall reference plane 80 is positioned between the front wall 14 and the back wall 18, and angled with respect to the floor reference plane 76 at about ten degrees (10°).

The front wall 14 defines a straight surface from the inlet 28 to the outlet 32 (as shown in FIG. 6). In the x-axis (generally), the front wall 14 is curved (as shown in FIG. 2). In the illustrated construction, throughout the curved portion of the front wall 14, the line from the inlet 28 to the outlet 32 is substantially straight, as shown in FIG. 6. A front wall line 84 is arranged relative to the front/back wall reference plane 80 at a front wall angle 88. The front wall angle 88 may be greater than or equal to zero degrees (x≥0°). In some embodiments, the front wall angle 88 is between about zero degrees and about three degrees (0°≤x≤3°). In the illustrated embodiment, the front wall angle 88 is about zero degrees (0°).

In the illustrated embodiment (see FIG. 6), the lip 36 is in line or parallel with the front wall 14. In other embodiments, the lip 36 could be skewed or angled relative to the front wall 14, as desired.

The back wall 18 defines (see FIG. 2) a planar portion, and two curved portions that connect the back wall 18 to the left side wall 22 and the right side wall 24. A straight surface is defined from the inlet 28 to the outlet 32 (as shown in FIG. 6). A back wall line 92 is angled or skewed relative to the front/back wall reference plane 80 at a back wall angle 96. The back wall angle 96 may be between about zero degrees and about thirty degrees (0°≤x≤30°). In some embodiments, the back wall angle 96 is between about one degree and about ten degrees (1°≤x≤10°). In the illustrated embodiment, the back wall angle 96 is about five degrees (5°).

With continued reference to FIG. 6, an inlet plane 100 is defined generally perpendicular to the floor reference plane 76 at the inlet 28. An inlet area 104 for the dipper 10 is defined in the inlet plane 100. That is to say, the front wall 14, the back wall 18, the left side wall 22, and the right side wall 26 define an inlet perimeter in the inlet plane 100, and the area within the inlet perimeter defines the inlet area 104 in the inlet plane 100.

An outlet plane 108 is defined parallel to the inlet plane 100 (and generally perpendicular to the floor reference plane 76) at the outlet 32. An outlet area 112 for the dipper 10 (e.g., at the door) is defined in the outlet plane 108. That is to say, the front wall 14, the back wall 18, the left side wall 22, and the right side wall 26 define an outlet perimeter in the outlet plane 108, and the area within the outlet perimeter defines the outlet area 112 in the outlet plane 108.

Figure 7:
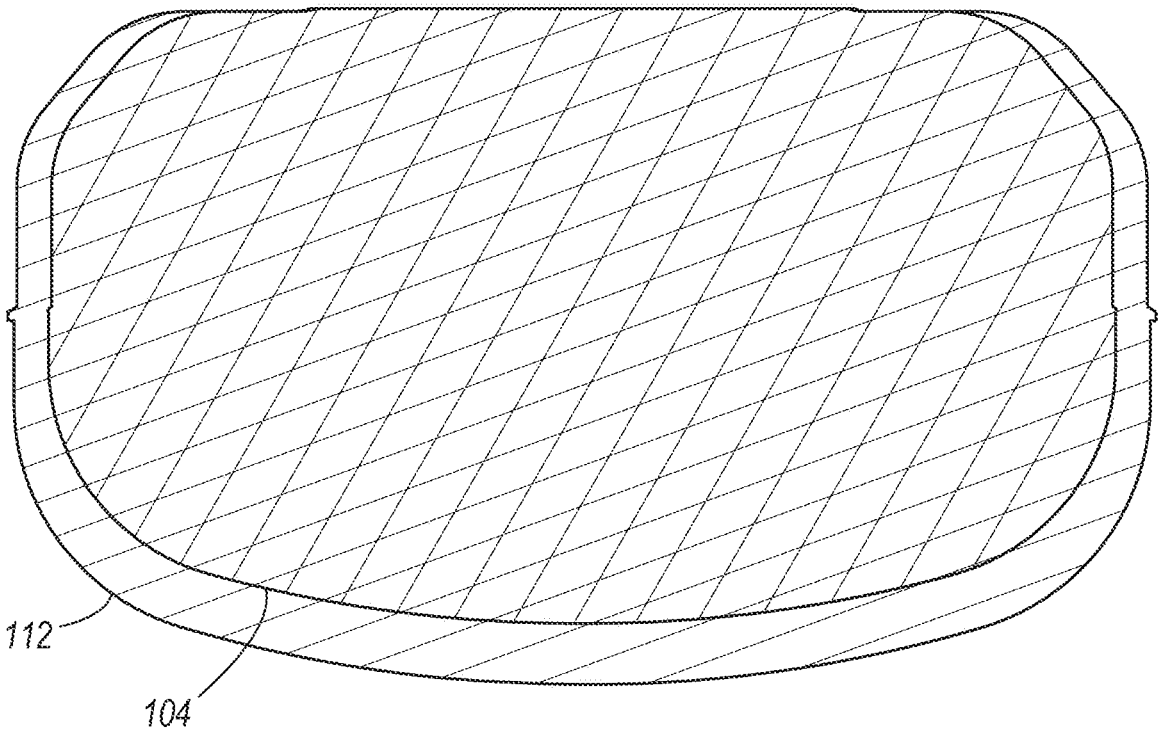
FIG. 7 is a representative view comparing an inlet area to an outlet area of the dipper shown in FIG. 1.

As a result of arrangement of the front wall 14, the back wall 18, the left side wall 22, and the right side wall 24, the outlet area 112 is larger than the inlet area 104 (see FIG. 7). The outlet area 112 may be between about three percent and about twenty-five percent (3%≤x≤25%) larger than the inlet area 104. In some embodiments, the outlet area 112 may be more than about four percent (4%) larger than the inlet area 104. In other embodiments, the outlet area 112 may be about eight percent to about nine percent (8%≤x≤9%) larger than the inlet area 104. In the illustrated embodiment, the outlet area 112 is about ten percent (10%) larger than the inlet area 104.

The inventive arrangement provides a dipper 10 that improves performance in digging. For example, the dipper 10 may have improved fill, dump and/or full/dump cycle time. The dipper 10 may have reduced drag during digging.

The dipper 10 may be advantageous for oil sands digging. Oil sands expand after being unearthed. The increased volume of the dipper 10 toward the outlet 32 of the dipper 10 allows the oil sands to expand within the dipper 10 while a digging action is occurring, and the oil sands will not be compacted within the dipper 10. Typically, oil sands expand about four percent (4%) in volume during a digging action (e.g., 30 seconds). The straight tapered design of the dipper 10 allows expansion without compaction and/or improves digging characteristics and efficiency. The dipper 10 may also be used to remove/mine other materials, such as, for example, copper, iron ore, overburden material, etc.

What is claimed is:

1. A dipper having an inlet and an outlet, the dipper comprising:

a front wall and an opposite back wall extending between the inlet and the outlet, the front wall having a substantially linear inner surface between the inlet and the outlet, the inlet defining an inlet plane;

a heel defined on the front wall adjacent the outlet;

two side walls connected between the front wall and the back wall and extending between the inlet and the outlet; and a lip coupled to the front wall and extending outwardly from the inlet in a direction away from the outlet, the lip having a lip inner surface positioned outward of the inlet and arranged generally parallel with the substantially linear inner surface of the front wall;

wherein a floor reference plane is defined generally perpendicular to the inlet plane, the floor reference plane intersecting the lip and being spaced apart from the heel.

2. The dipper of claim 1, wherein the lip inner surface is generally in line with the substantially linear inner surface of the front wall.

3. The dipper of claim 1, wherein a front/back wall reference plane extends from the inlet to the outlet and is positioned between the front wall and the back wall, and wherein the front/back wall reference plane is angled with respect to the floor reference plane at about ten degrees.

4. The dipper of claim 3, wherein a front wall line is defined by the substantially linear inner surface of the front wall line, wherein the front wall line is arranged relative to the front/back wall reference plane at a front wall angle between about zero degrees and about three degrees.

5. The dipper of claim 4, wherein the front wall angle is about zero degrees.

6. The dipper of claim 1, wherein a side wall reference plane extends from the inlet to the outlet and is positioned between the side walls, and wherein the lip defines opposite side surfaces, each of the side surfaces tapering outwardly from the inlet relative to the side wall reference plane at an angle greater than 0 degrees and no more than about 30 degrees.

7. The dipper of claim 6, wherein each of the side surfaces tapers outwardly from the inlet relative to the side wall reference plane at an angle greater than 0 degrees and no more than about 10 degrees.

8. The dipper of claim 1, wherein a maximum outer dimension of the lip is larger than a comparative outer dimension of the outlet.

9. The dipper of claim 1, wherein the front and the back walls define a front/back wall reference plane extending from the inlet to the outlet and positioned between the front wall and the back wall, and wherein the back wall tapers outwardly relative to the front/back wall reference plane from the inlet to the outlet.

10. The dipper of claim 9, wherein the back wall tapers outwardly relative to the front/back wall reference plane at an angle greater than 0 degrees and no more than about 30 degrees.

11. The dipper of claim 10, wherein the back wall tapers outwardly relative to the front/back wall reference plane at an angle greater than about 1 degree and no more than about 10 degrees.

12. The dipper of claim 1, wherein the two side walls define a side wall reference plane extending from the inlet to the outlet and positioned between the side walls, and wherein each of the side walls tapers outwardly relative to the side wall reference plane from the inlet to the outlet.

13. The dipper of claim 12, wherein each of the side walls tapers outwardly relative to the side wall reference plane at an angle greater than 0 degrees and no more than about 30 degrees.

14. The dipper of claim 13, wherein each of the side walls tapers outwardly relative to the side wall reference at an angle greater than about 1 degree and no more than about 10 degrees.

* * * * *